US009777974B2

(12) United States Patent
Kamitani et al.

(10) Patent No.: US 9,777,974 B2
(45) Date of Patent: Oct. 3, 2017

(54) COOLING DEVICE AND HEATING AND COOLING APPARATUS

(71) Applicant: MURATA MANUFACTURING CO., LTD., Nagaokakyo-Shi, Kyoto-fu (JP)

(72) Inventors: Gaku Kamitani, Nagaokakyo (JP); Atsuhiko Hirata, Nagaokakyo (JP)

(73) Assignee: MURATA MANUFACTURING CO., LTD., Nagaokakyo-Shi, Kyoto-Fu (JP)

( * ) Notice: Subject to any disclaimer, the term of this patent is extended or adjusted under 35 U.S.C. 154(b) by 434 days.

(21) Appl. No.: 14/536,126

(22) Filed: Nov. 7, 2014

(65) Prior Publication Data

US 2015/0060012 A1 Mar. 5, 2015

Related U.S. Application Data

(63) Continuation of application No. PCT/JP2013/061826, filed on Apr. 23, 2013.

(30) Foreign Application Priority Data

May 9, 2012 (JP) ..... 2012-107904

(51) Int. Cl.
*F28F 27/02* (2006.01)
*F04B 43/04* (2006.01)
*F28D 21/00* (2006.01)

(52) U.S. Cl.
CPC ..... *F28F 27/02* (2013.01); *F04B 43/046* (2013.01); *F28D 2021/0029* (2013.01); *F28F 2250/08* (2013.01)

(58) Field of Classification Search
CPC .. F24F 7/00; F04B 17/00; F04B 43/02; F04B 43/04; F04B 43/046; F04B 45/047; F28F 2250/08; F28F 27/02; F28D 2021/0029
(Continued)

(56) References Cited

U.S. PATENT DOCUMENTS 3,844,529 A 10/1974 Brandt, Jr. et al.
7,717,682 B2 * 5/2010 Orr ..... F04B 7/02 417/395

(Continued)

FOREIGN PATENT DOCUMENTS

JP S50-69620 A 6/1975
JP 3-29397 A 2/1991

(Continued)

OTHER PUBLICATIONS

Written opinion and International Search Report issued in PCT/JP2013/061826 dated Jul. 30, 2013.

*Primary Examiner* — Len Tran
*Assistant Examiner* — Gustavo Hincapie Serna
(74) *Attorney, Agent, or Firm* — Arent Fox LLP

(57) ABSTRACT

An analyzing device includes a heating device, a cooling device, and a controller. The cooling device includes a piezoelectric pump, a check valve, an exhaust valve, and an air tank. The analyzing device heats a subject by the heating device. The cooling device drives the piezoelectric pump while the heating device heating the subject. With this, the outside air is sucked through a suction port and the air that is discharged from the piezoelectric pump is accommodated in the air tank through the check valve. Then, the pressure in the air tank is increased. Thereafter, the cooling device stops driving of the piezoelectric pump. With this, the air in the air tank is discharged toward the subject via the exhaust valve so as to cool the subject.

8 Claims, 11 Drawing Sheets

(58) Field of Classification Search
USPC ..... 417/395, 413.1, 413.2; 137/82; 251/61, 251/61.1; 165/96
See application file for complete search history.

(56) References Cited

U.S. PATENT DOCUMENTS

| | | | | |
|---|---|---|---|---|
| 8,197,231 | B2 * | 6/2012 | Orr | F04B 7/02 137/512.4 |
| 8,382,452 | B2 * | 2/2013 | Richter | F04B 43/043 417/413.1 |
| 8,596,998 | B2 * | 12/2013 | Fujisaki | F04B 45/047 417/413.1 |
| 2005/0019180 | A1 * | 1/2005 | Seto | F04B 43/046 417/413.1 |
| 2009/0232682 | A1 | 9/2009 | Hirata et al. | |
| 2012/0051946 | A1 * | 3/2012 | Lee | F04B 43/046 417/53 |
| 2013/0266461 | A1 * | 10/2013 | Hirata | F04B 17/003 417/413.2 |

FOREIGN PATENT DOCUMENTS

| | | | |
|---|---|---|---|
| JP | H09-257374 | A | 10/1997 |
| JP | 2001-248561 | A | 9/2001 |
| JP | 2005-148624 | A | 6/2005 |
| JP | 2009-156454 | A | 7/2009 |
| WO | WO-2008-069266 | A1 | 6/2008 |

* cited by examiner

COOLING DEVICE AND HEATING AND COOLING APPARATUS

CROSS REFERENCE TO RELATED APPLICATIONS

The present application is a continuation of PCT/JP2013/061826 filed Apr. 23, 2013, which claims priority to Japanese Patent Application No. 2012-107904, filed May 9, 2012, the entire contents of each of which are incorporated herein by reference.

FIELD OF THE INVENTION

The present invention relates to a cooling device that sends air toward a cooling target object so as to cool the cooling target object and a heating and cooling apparatus including the cooling device.

BACKGROUND OF THE INVENTION

Patent Document 1 discloses a piezoelectric micro blower that sends air toward a cooling target object such as a CPU so as to cool the cooling target object.

FIG. 12 includes cross-sectional views illustrating a main part of the piezoelectric micro blower in Patent Document 1. FIG. 12(*a*) illustrates an initial state of the piezoelectric micro blower (when voltage is not applied thereto). FIGS. 12(*b*) to 12(*e*) illustrate blower operations of the piezoelectric micro blower when a diaphragm 2 as illustrated in FIG. 12(*a*) is bent and deformed in a primary resonance mode. Arrows in FIGS. 12(*b*) to 12(*e*) indicate flow of the air.

As illustrated in FIG. 12(*a*), the piezoelectric micro blower includes a blower main body 1, the diaphragm 2, and a piezoelectric element 3. The outer circumferential portion of the diaphragm 2 is fixed to the blower main body 1. The piezoelectric element 3 is bonded to a center portion of the rear surface of the diaphragm 2. A blower chamber 4 is formed between a first wall portion 1*a* of the blower main body 1 and the diaphragm 2. A first opening 5*a* communicating with the blower chamber 4 is formed on a region of the first wall portion 1*a*, which opposes the center portion of the diaphragm 2.

A second wall portion 1*b* is provided on the blower main body 1 so as to be spaced from the first wall portion 1*a*. A second opening 5*b* communicating with the blower chamber 4 is formed on a region of the second wall portion 1*b*, which opposes the first opening 5*a*. An inlet passage 7 communicating with the first opening 5*a* and the second opening 5*b* is formed between the first wall portion 1*a* and the second wall portion 1*b*.

In the above-mentioned configuration, when a driving voltage is applied to the piezoelectric element 3, as illustrated in FIGS. 12(*b*) to 12(*e*), the diaphragm 2 is bent and deformed with expansion and contraction of the piezoelectric element 3, so that a volume of the blower chamber 4 changes periodically.

First, as illustrated in FIG. 12(*b*), when the driving voltage is applied to the piezoelectric element 3 and the diaphragm 2 is bent to the piezoelectric element 3 side, the volume of the blower chamber 4 is increased. Accompanied with this, a part of the air in the inlet passage 7 is sucked into the blower chamber 4 through the first opening 5*a*.

Then, as illustrated in FIGS. 12(*c*) and 12(*d*), when the driving voltage is applied to the piezoelectric element 3 and the diaphragm 2 is bent to the blower chamber 4 side, the volume of the blower chamber 4 is decreased. Accompanied with this, the air in the blower chamber 4 is discharged through the second opening 5*b* via the first opening 5*a*.

In this case, the airflow that is discharged from the blower chamber 4 discharges air present at the outside of the blower main body 1 through the second opening 5*b* while sucking the air via the inlet passage 7. Thereafter, the diaphragm 2 is returned to the state as illustrated in FIG. 12(*b*) after having experienced the state as illustrated in FIG. 12(*e*).

The piezoelectric micro blower in Patent Document 1 cools the cooling target object such as the CPU by directing the second opening 5*b* to the cooling target object so as to discharge the air sucked from the outside of the blower main body 1 toward the cooling target object.

Patent Document 1: International Publication No. 2008/069266

In the piezoelectric micro blower in Patent Document 1, the temperature of the air that is discharged onto the cooling target object is the same as the temperature (hereinafter, referred to as "environment temperature") of the air at the outside of the blower main body 1. Therefore, the piezoelectric micro blower in Patent Document 1 cannot cool the cooling target object to a temperature lower than the environment temperature.

Further, the piezoelectric micro blower in Patent Document 1 is reduced in size, so that a flow rate of the air that can be sucked from the outside of the blower main body 1 is low. Due to this, a discharge flow rate is low and it takes a long time to cool the cooling target object.

Accordingly, the piezoelectric micro blower in Patent Document 1 has a problem that it cannot cool the cooling target object to a temperature equal to or lower than the environment temperature quickly.

SUMMARY OF THE INVENTION

An object of the present invention is to provide a small-sized cooling device capable of cooling a cooling target object to a temperature equal to or lower than an environment temperature quickly and a heating and cooling apparatus including the cooling device.

A cooling device according to an aspect of the invention has the following configuration in order to achieve the above-mentioned object.

(1) A cooling device includes a pump having a suction hole and a discharge hole, a tank for accommodating a gas, and a valve having a first ventilation hole connected to the discharge hole of the pump, a second ventilation hole connected to the tank, and an exhaust hole for exhausting the gas in the tank toward a cooling target object; the valve switches states between a first communication state where the first ventilation hole and the second ventilation hole are made to communicate with each other and ventilation between the second ventilation hole and the exhaust hole is blocked and a second communication state where ventilation between the first ventilation hole and the second ventilation hole is blocked and the second ventilation hole and the exhaust hole are made to communicate with each other.

In the configuration, the tank is a pressure-tight container.

With the configuration, when the valve is in the first communication state, if the pump is driven, the gas at the outside of the cooling device is sent to the tank through the discharge hole of the pump via the first ventilation hole and the second ventilation hole. When the gas is continued to be sent to the tank, the gas in the tank is compressed and a pressure of the gas in the tank is gradually increased. At the same time, the temperature of the gas in the tank is also gradually increased.

Heat of the gas is conducted to the tank, so that the increased temperature of the gas becomes lower over time so as to be close to the temperature (environment temperature) of the outside of the tank.

Then, when the valve switches to the second communication state from the first communication state, the second ventilation hole and the exhaust hole are made to communicate with each other. Therefore, the compressed gas in the tank is released into the atmosphere and is adiabatically expanded, so that the temperature of the gas becomes lower than the environment temperature.

Thereafter, the gas of which temperature is lower than the environment temperature is discharged through the exhaust hole via the second ventilation hole quickly. With this, the gas having a high flow rate of which temperature is lower than the environment temperature is discharged toward the cooling target object through the exhaust hole instantaneously.

Accordingly, with this configuration, the cooling device can cool the cooling target object to a temperature lower than the environment temperature quickly while being reduced in size.

(2) The valve includes a valve housing in which the first ventilation hole, the second ventilation hole, and the exhaust hole are formed and a diaphragm that divides an inner portion of the valve housing so as to configure a first region communicating with the first ventilation hole and a second region communicating with the second ventilation hole in the valve housing; the diaphragm is fixed to the valve housing such that the first ventilation hole and the second ventilation hole are made to communicate with each other and ventilation between the second ventilation hole and the exhaust hole is blocked when a pressure in the first region is higher than a pressure in the second region, and ventilation between the first ventilation hole and the second ventilation hole is blocked and the second ventilation hole and the exhaust hole are made to communicate with each other when the pressure in the first region is lower than the pressure in the second region.

With this configuration, when the pump is driven, the gas flows into to the first region in the valve housing through the discharge hole of the pump via the first ventilation hole. This causes the pressure in the first region to be higher than the pressure in the second region in the valve housing, so that the first ventilation hole and the second ventilation hole are made to communicate with each other and ventilation between the second ventilation hole and the exhaust hole is blocked.

As a result, the gas is sent to the tank via the first ventilation hole and the second ventilation hole from the pump. When the gas is continued to be sent to the tank, the gas is compressed and the pressure of the gas is gradually increased. At the same time, the temperature of the gas in the tank is gradually increased. Heat of the gas is conducted to the tank, so that the increased temperature of the gas becomes lower over time so as to be close to the temperature (environment temperature) of the outside of the tank.

Then, when the driving of the pump is stopped, the gas present in the pump chamber and the first region is discharged to the outside of the pump through the suction hole of the pump via the discharge hole of the pump because the volumes of the pump chamber and the first region are extremely smaller than the volume of the gas that can be accommodated in the tank.

As a result, when the driving of the pump is stopped, the pressure in the first region becomes lower than the pressure in the second region in the valve housing. When the pressure in the first region becomes lower than the pressure in the second region, ventilation between the first ventilation hole and the second ventilation hole is blocked and the second ventilation hole and the exhaust hole are made to communicate with each other.

Therefore, the compressed gas in the tank is released into the atmosphere and is adiabatically expanded, so that the temperature of the gas becomes lower than the environment temperature. Thereafter, the gas of which temperature is lower than the environment temperature is discharged through the exhaust hole via the second ventilation hole quickly. With this, the gas having a high flow rate of which temperature is lower than the environment temperature is discharged toward the cooling target object through the exhaust hole instantaneously.

Accordingly, with this configuration, the cooling device can cool the cooling target object to a temperature lower than the environment temperature quickly while being reduced in size.

(3) A heat sink is attached to the tank.

With this configuration, heat of the gas that has been sent to the tank with driving of the pump and of which temperature has been increased is conducted to the heat sink from the tank and dissipated. In this configuration, the heat sink having the excellent heat conductivity is attached to the tank, so that the temperature of the gas in the tank lowers to the environment temperature quickly.

(4) The diaphragm configures, together with the valve housing, a check valve for controlling communication between the first ventilation hole and the second ventilation hole with pressure difference between the first region and the second region and an exhaust valve for controlling communication between the second ventilation hole and the exhaust hole with pressure difference between the first region and the second region.

In this configuration, the cooling device includes the check valve, the exhaust valve, and the pump.

When the pressure in the first region is higher than the pressure in the second region, the check valve causes the first ventilation hole and the second ventilation hole to communicate with each other and the exhaust valve blocks ventilation between the second ventilation hole and the exhaust hole.

On the other hand, when the pressure in the first region is lower than the pressure in the second region, the check valve blocks ventilation between the first ventilation hole and the second ventilation hole and the exhaust valve causes the second ventilation hole and the exhaust hole to communicate with each other.

(5) The diaphragm is configured by a single flexible plate.

In this configuration, the diaphragm is configured by the single flexible plate, thereby reducing the manufacturing cost of the cooling device.

A heating and cooling apparatus according to another aspect of the invention has the following configuration in order to achieve the above-mentioned object.

(6) A heating and cooling apparatus includes the cooling device according to any one of the aspects (1) to (5), and a heating device for heating a heating and cooling target object; the pump of the cooling device is driven while the heating device heating the heating and cooling target object and driving of the pump of the cooling device is stopped after the heating device has completed the heating of the heating and cooling target object.

This configuration also enables the heating and cooling apparatus including the cooling device to obtain the same effects by using the cooling device according to any one of the aspects (1) to (5).

Further, in this configuration, the tank is filled with the gas while the heating device heating the heating and cooling target object, and the gas is discharged toward the heating and cooling target object to cool it after the heating device has completed the heating of the heating and cooling target object. With this configuration, heating and cooling can be performed quickly.

Note that in this configuration, the following pump may be used. That is, the pump includes an actuator of which peripheral edge portion is not restrained substantially and that bends and vibrates in a region from the center portion to the peripheral edge portion and a flexible plate that is arrange so as to be close to and oppose to the actuator, and one or a plurality of ventilation holes are formed on an actuator opposition region of the flexible plate, which opposes the actuator.

With this configuration, the pump capable of providing a high pressure and a high flow rate while being reduced in size and height is used. Therefore, the cooling device and the heating and cooling apparatus reduced in size and height can be provided.

The present invention can provide a cooling device capable of cooling a cooling target object to a temperature lower than an environment temperature quickly and a heating and cooling apparatus including the cooling device.

DETAILED DESCRIPTION OF THE PREFERRED EMBODIMENTS

<<First Embodiment>>

Hereinafter, an analyzing device 10 according to a first embodiment of the present invention is described.

Figure 1:
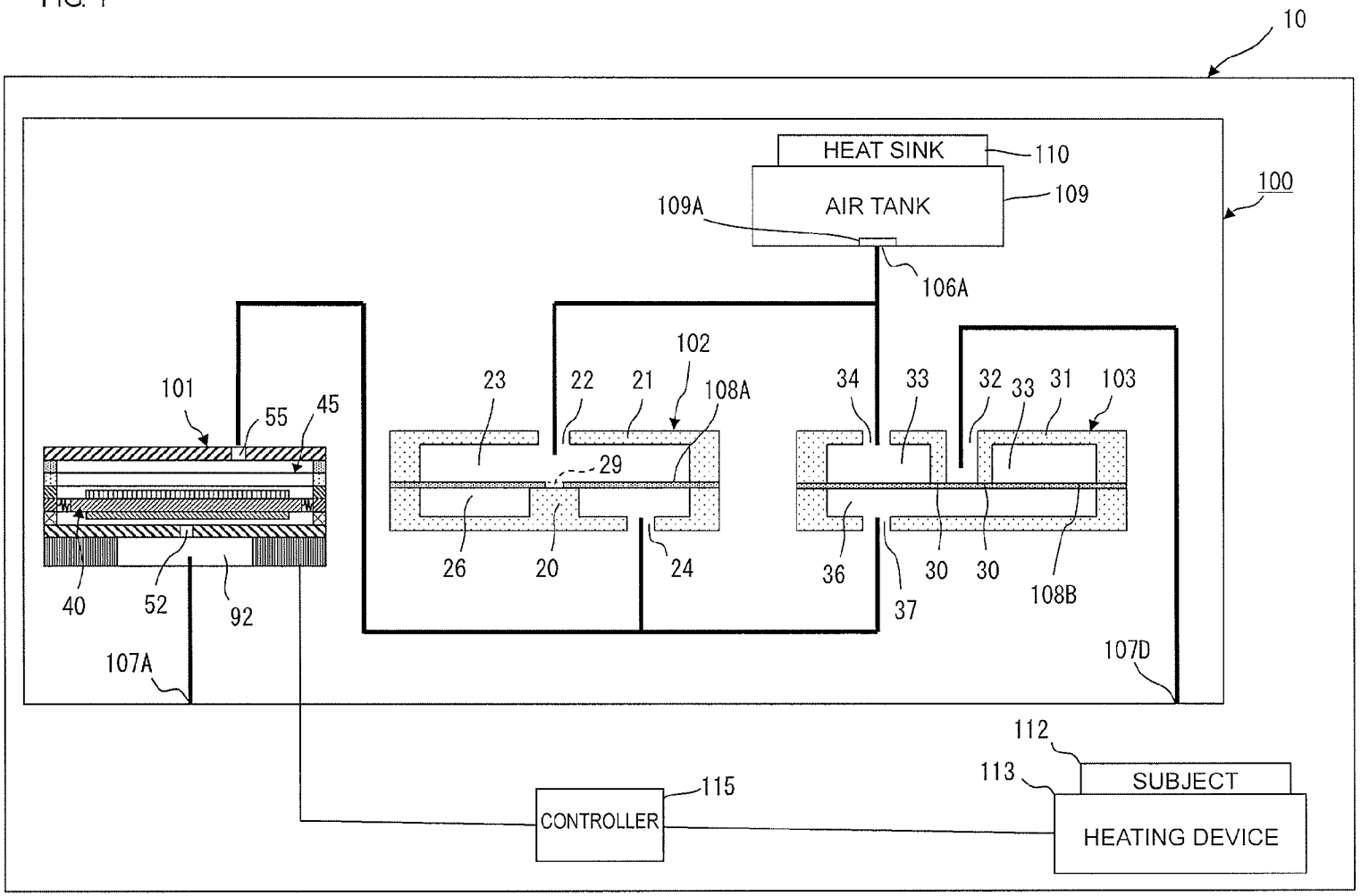
FIG. 1 is a block diagram illustrating the configuration of a main part of an analyzing device 10 according to a first embodiment of the present invention.

FIG. 1 is a block diagram illustrating the configuration of a main part of the analyzing device 10 in the first embodiment of the invention. The analyzing device 10 includes a heating device 113, a cooling device 100, and a controller 115. The analyzing device 10 is a device that analyzes a base sequence of nucleic acid such as DNA and RNA, for example.

A subject 112 is placed on the heating device 113 by a transportation unit (not illustrated). The subject 112 is a container accommodating DNA. In general, analysis of the base sequence of the DNA is performed after the DNA is heated to be denatured.

The cooling device 100 includes a piezoelectric pump 101, a check valve 102, an exhaust valve 103, and an air tank 109. The cooling device 100 sends air to the subject 112 on the heating device 113 so as to cool the subject 112.

The air tank 109 is a tank for accommodating the air and a heat sink 110 is attached to an outer side portion of the air tank 109. The air tank 109 and the heat sink 110 are made of a material having excellent heat conductivity, such as aluminum, for example.

The controller 115 is configured by a microcomputer, for example, and controls operations of the respective parts of the analyzing device 10. The controller 115 is connected to each of the piezoelectric pump 101 and the heating device 113 and transmits a control signal to each of the piezoelectric pump 101 and the heating device 113. To be more specific, the controller 115 generates an alternating-current driving voltage from a commercial alternating-current power supply and applies it to the piezoelectric pump 101 so as to drive the piezoelectric pump 101.

The analyzing device 10 corresponds to a "heating and cooling apparatus" in the invention. The subject 112 corresponds to a "cooling target object" in the invention, and corresponds to a "heating and cooling target object" in the invention. The check valve 102 corresponds to a "check valve" in the invention and the exhaust valve 103 corresponds to an "exhaust valve" in the invention. A combined entity of the check valve 102 and the exhaust valve 103 corresponds to a "valve" in the invention.

Hereinafter, the configuration of the cooling device 100 is described in detail.

Figure 2:
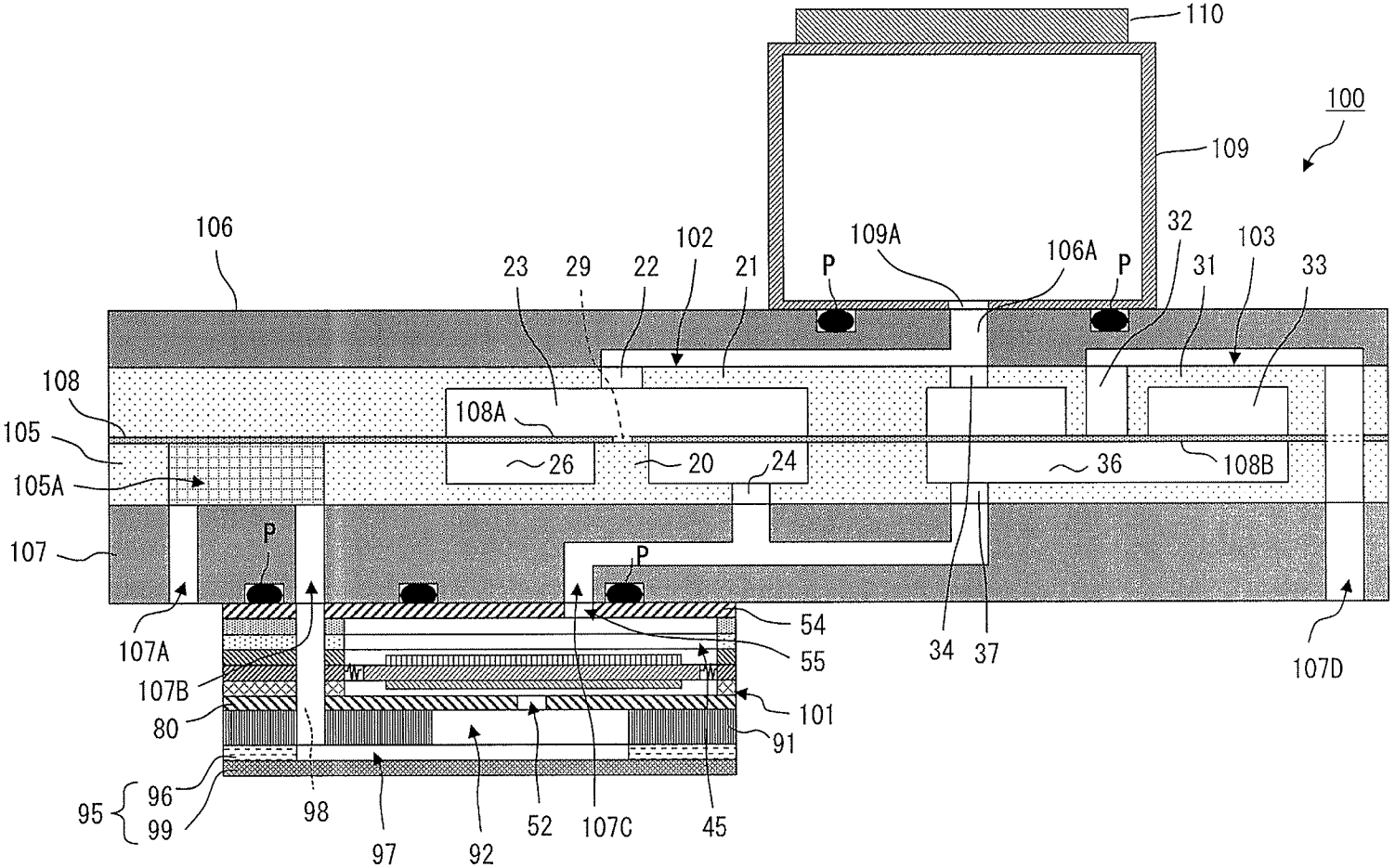
FIG. 2 is a cross-sectional view illustrating a main part of a cooling device 100 as illustrated in FIG. 1.

FIG. 2 is a cross-sectional view illustrating a main part of the cooling device 100 as illustrated in FIG. 1. The cooling device 100 has a configuration in which the piezoelectric pump 101, a substrate 107, a valve housing 105, and a lid member 106 are laminated in this order.

The valve housing 105 configures a dustproof filter 105A, the check valve 102, and the exhaust valve 103 together with a diaphragm 108. That is, the check valve 102 and the exhaust valve 103 are formed integrally.

A connection port 106A is formed on the lid member 106. The air tank 109 is bonded to the lid member 106 through packings P after being positioned such that a ventilation port 109A of the air tank 109 communicates with the connection port 106A of the lid member 106.

A suction port 107A, an inlet path 107B, an outlet path 107C, and a discharge port 107D are formed on the substrate 107. The suction port 107A is a port for sucking the outside air. The inlet path 107B is a path for causing the air that has passed through the dustproof filter 105A to flow into the piezoelectric pump 101. The outlet path 107C is a path for causing the air discharged from the piezoelectric pump 101 to flow out into the valve housing 105. The discharge port 107D is a port for discharging the air in the air tank 109.

The piezoelectric pump 101 is bonded to the substrate 107 through packings P after being positioned such that a through-hole 98 and a discharge hole 55 of the piezoelectric pump 101 communicate with the inlet path 107B and the outlet path 107C of the substrate 107, respectively.

A material of the diaphragm 108 is an elastic material such as ethylene propylene rubber or silicone rubber, for example. The diaphragm 108 is configured by a single flexible plate like a diaphragm sheet, for example. This can reduce the manufacturing cost of the cooling device 100.

The configurations of the piezoelectric pump 101, the check valve 102, and the exhaust valve 103 included in the cooling device 100 are described in detail. First, the configuration of the piezoelectric pump 101 is described in detail with reference to FIG. 2, FIG. 3, and FIG. 4.

Figure 3:
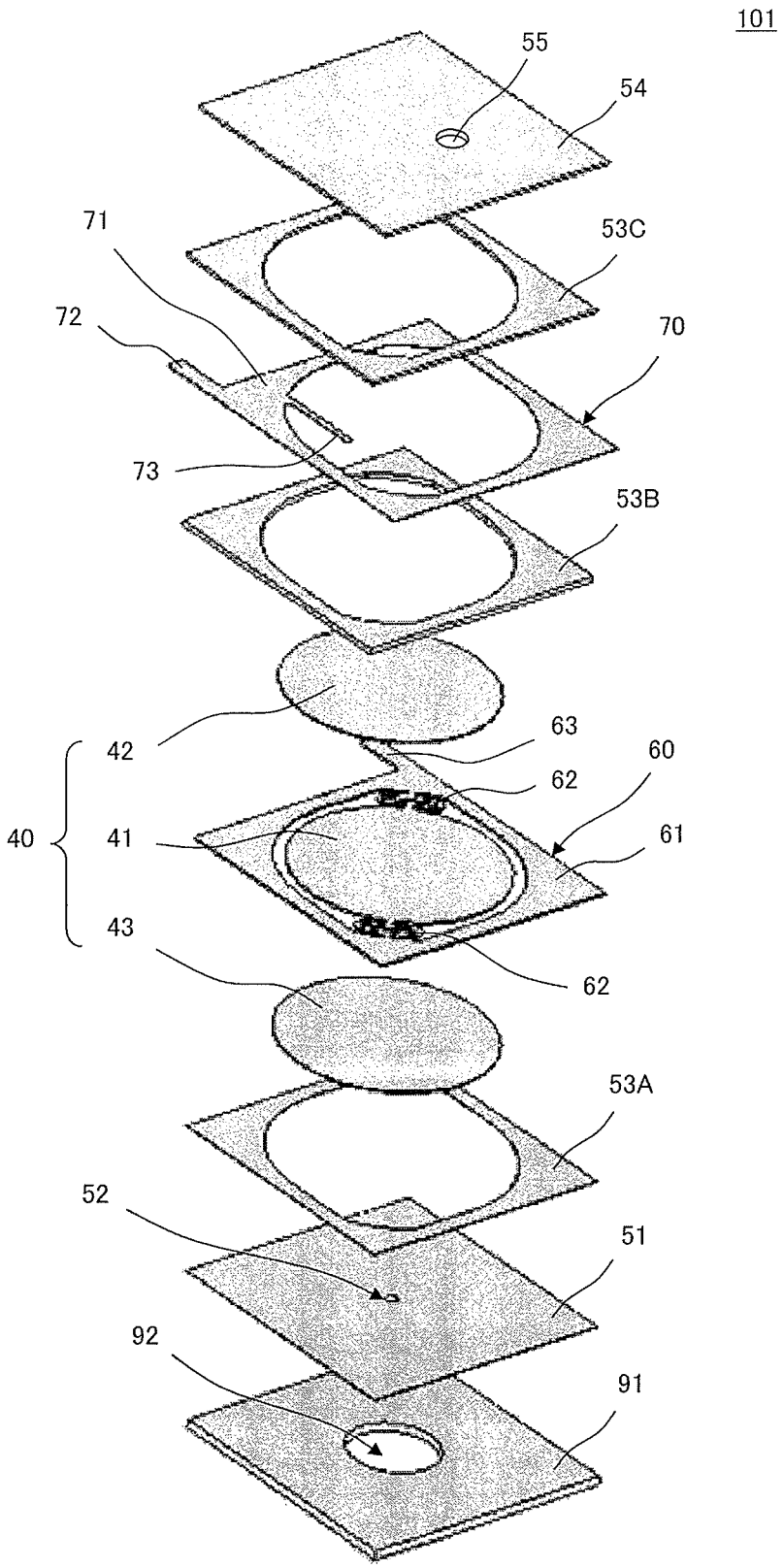
FIG. 3 is an exploded perspective view illustrating a piezoelectric pump 101 as illustrated in FIG. 1.
Figure 4:
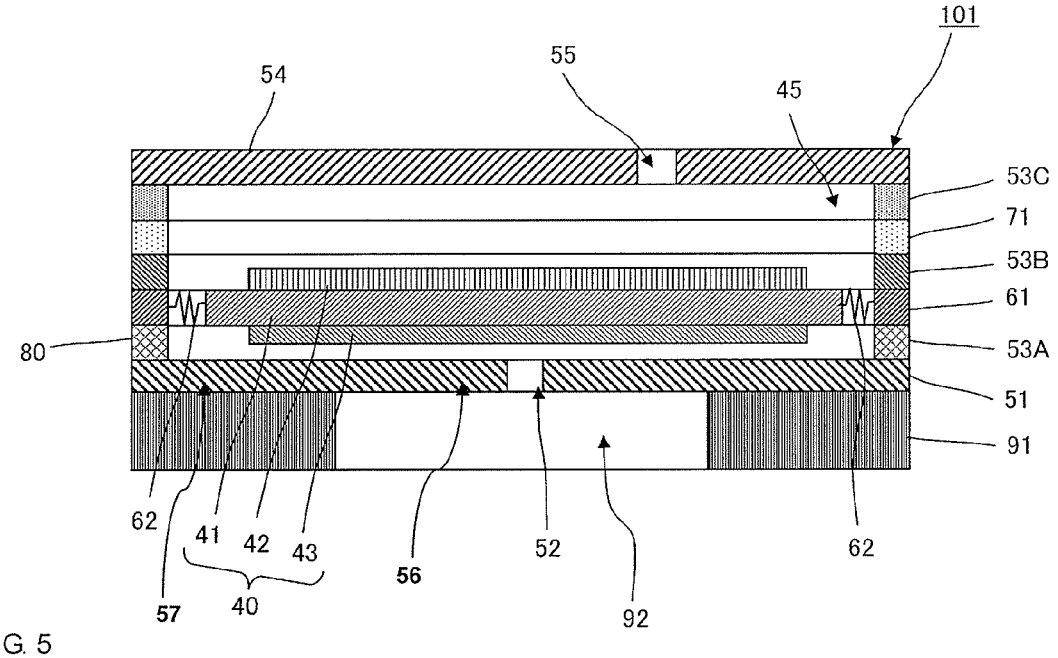
FIG. 4 is a cross-sectional view illustrating a main part of the piezoelectric pump 101 as illustrated in FIG. 1.

FIG. 3 is an exploded perspective view illustrating the piezoelectric pump 101 as shown in FIG. 1 and FIG. 4 is a cross-sectional view illustrating a main part of the piezoelectric pump 101. The piezoelectric pump 101 includes a substrate 91, a flexible plate 51, a spacer 53A, a reinforcing plate 43, a vibration plate unit 60, a piezoelectric element 42, a spacer 53B, an electrode conduction plate 70, a spacer 53C, and a lid plate 54 and has a configuration in which they are laminated in this order.

The piezoelectric element 42 is made to adhere to and is fixed to the upper surface of a circular plate-like vibration plate 41. The reinforcing plate 43 is bonded to the lower surface of the vibration plate 41. The vibration plate 41, the piezoelectric element 42, and the reinforcing plate 43 configure a circular plate-like piezoelectric actuator 40. The piezoelectric element 42 is made of PZT-based ceramics, for example.

The vibration plate 41 is a metal plate having a coefficient of linear expansion that is larger than those of the piezoelectric element 42 and the reinforcing plate 43. Therefore, even when adhesion is performed through heating and curing, an appropriate compression stress remains in the piezoelectric element 42, without warping overall. This can prevent the piezoelectric element 42 from being broken. For example, the vibration plate 41 is preferably made of a material having a large coefficient of linear expansion, such as phosphor bronze (C5210) or stainless steel SUS301, and the reinforcing plate 43 is preferably made of 36 or 42 nickel, stainless steel SUS430, or the like.

With regard to the vibration plate 41, the piezoelectric element 42, and the reinforcing plate 43, they may be arranged in the order of the piezoelectric element 42, the reinforcing plate 43, and the vibration plate 41 from the top. In order to cause the appropriate compression stress to remain on the piezoelectric element 42 in this case, the material of the reinforcing plate 43 and the material of the vibration plate 41 are switched so as to adjust the coefficient of linear expansion.

A frame plate 61 is provided around the vibration plate 41 and the vibration plate 41 is coupled to the frame plate 61 with coupling portions 62. For example, the coupling portions 62 are formed into thin ring forms, for example, and have an elastic structure with elasticity of a small spring constant.

Accordingly, the vibration plate 41 is flexibly supported on the frame plate 61 with the two coupling portions 62 at two places. Therefore, bending vibration of the vibration plate 41 is not substantially inhibited. That is to say, the peripheral edge portion (and the center portion, of course) of the piezoelectric actuator 40 is not substantially restrained.

The spacer 53A is provided so as to hold the piezoelectric actuator 40 with a constant interval between the piezoelectric actuator 40 and the flexible plate 51. An external terminal 63 for electric connection is formed on the frame plate 61.

The vibration plate 41, the frame plate 61, the coupling portions 62, and the external terminal 63 are formed by performing punching processing on a metal plate and configure the vibration plate unit 60.

The spacer 53B made of resin is made to adhere to and fixed to the upper surface of the frame plate 61. The thickness of the spacer 53B is the same as or slightly larger than that of the piezoelectric element 42. The spacer 53B configures a part of a pump housing 80 and electrically insulates the electrode conduction plate 70 and the vibration plate unit 60 from each other, which will be described later.

The electrode conduction plate 70 made of metal is made to adhere to and fixed to the spacer 53B. The electrode conduction plate 70 is configured by a frame site 71, an internal terminal 73, and an external terminal 72. The frame site 71 is made to open in a substantially circular form. The internal terminal 73 projects into the opening. The external terminal 72 projects outward.

The front end of the internal terminal 73 is soldered on the surface of the piezoelectric element 42. The soldering position is set to a position corresponding to a node of bending vibration of the piezoelectric actuator 40, thereby suppressing vibration of the internal terminal 73.

The spacer 53C made of resin is made to adhere to and fixed to the electrode conduction plate 70. The spacer 53C has the thickness equivalent to the piezoelectric element 42. The spacer 53C is a spacer for preventing the soldering portion of the internal terminal 73 from making contact with the lid plate 54 when the piezoelectric actuator 40 vibrates. Further, the spacer 53C prevents the surface of the piezoelectric element 42 from making close to the lid plate 54 excessively to lower the vibration amplitude thereof due to air resistance. Therefore, it is sufficient that the thickness of the spacer 53C is equivalent to the thickness of the piezoelectric element 42 as described above.

The discharge hole 55 is formed in the lid plate 54. The lid plate 54 is put on an upper portion of the spacer 53C so as to cover the periphery of the piezoelectric actuator 40.

On the other hand, a suction hole 52 is formed at the center of the flexible plate 51. The spacer 53A having the thickness larger than the thickness of the reinforcing plate 43 by a few tens of micrometers is inserted between the flexible plate 51 and the vibration plate unit 60. Thus, even when the spacer 53A is present, the interval between the piezoelectric actuator 40 and the flexible plate 51 automatically changes in accordance with fluctuation of a pressure (load) to be applied to the discharge hole 55 because the vibration plate 41 is not restrained by the frame plate 61.

It should be noted that the vibration plate 41 receives influence by the restraint with the coupling portions 62 (spring terminals) more or less. Therefore, the interval can be ensured when load is small so as to increase the flow rate by intentionally inserting the spacer 53A. Further, also in the case where the spacer 53A is inserted, when load is large, the coupling portions 62 (spring terminals) will deflect and the interval on an opposing region between the piezoelectric actuator 40 and the flexible plate 51 is automatically reduced. This can cause to operate at a high pressure.

Although the coupling portions 62 are provided at two places in the example as illustrated in FIG. 3, the coupling portions 62 may be provided at equal to or more than three places. The coupling portions 62 do not inhibit the vibration of the piezoelectric actuator 40 but give influence on the vibration thereof more or less. Therefore, coupling (holding) at three places with the coupling portions 62, for example, provides holding more naturally and prevents the piezoelectric element 42 from being broken.

The substrate 91 in which an opening 92 having a cylindrical shape when seen from the above is formed at the center is provided under the flexible plate 51. A portion of the flexible plate 51, which covers the opening 92, can vibrate at substantially the same frequency as that of the piezoelectric actuator 40 by pressure fluctuation with the vibration of the piezoelectric actuator 40. With the configurations of the flexible plate 51 and the substrate 91, the portion of the flexible plate 51, which covers the opening 92, corresponds to a movable portion 56 capable of bending and vibrating, and a portion of the flexible plate 51 at an outer side relative to the movable portion 56 corresponds to a fixing portion 57 that is restrained by the substrate 91. The movable portion 56 includes the center region of the flexible plate 51, which opposes the actuator 40. The movable portion 56 is designed such that the natural frequency of the circular movable portion is equivalent to or slightly lower than a driving frequency of the piezoelectric actuator 40.

Accordingly, when an alternating-current driving voltage is applied to the external terminals 63 and 72 by the controller 115, the piezoelectric actuator 40 bends and vibrates concentrically. Further, the movable portion 56 of the flexible plate 51 about the suction hole 52 at the center also vibrates with a large amplitude in response to the vibration of the piezoelectric actuator 40. When the flexible plate 51 vibrates in such a manner that the vibration phase thereof is delayed relative to the vibration phase of the piezoelectric actuator 40 (delayed by 90°, for example), the thickness fluctuation of the interval space between the flexible plate 51 and the piezoelectric actuator 40 is substantially increased. This can improve the capability of the pump.

As illustrated in FIG. 2, a cover plate portion 95 is provided under the substrate 91. The cover plate portion 95 is formed by bonding a flow path plate 96 and a cover plate 99 to each other. Further, the through-hole 98 is formed in the pump housing 80. With these, the piezoelectric pump 101 has a shape in which an L-shaped communication path 97 that makes the inlet path 107B and the opening 92 communicate with each other is formed.

Next, the structure of the check valve 102 is described in detail with reference to FIG. 2 and FIG. 5.

Figure 5:
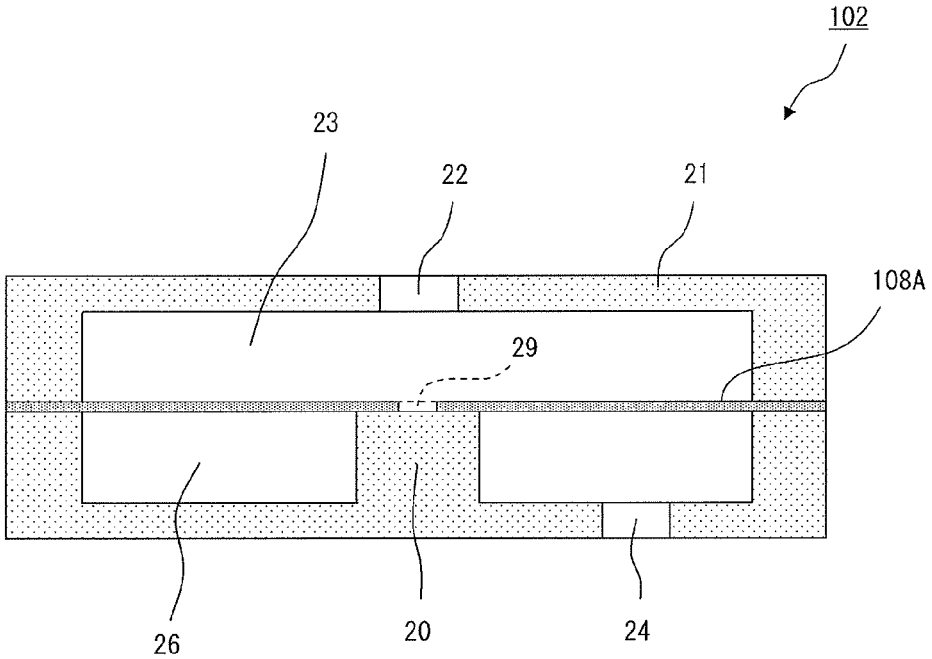
FIG. 5 is a cross-sectional view illustrating a main part of a check valve 102 as illustrated in FIG. 1.

FIG. 5 is a cross-sectional view illustrating a main part of the check valve 102 as illustrated in FIG. 1. The check valve 102 includes a cylindrical first valve housing 21 and a first diaphragm 108A formed by a circular thin film. The first diaphragm 108A is a region of the diaphragm 108 configuring the check valve 102.

A first communication hole 24, a second communication hole 22, and a cylindrical projecting portion 20 are formed in the first valve housing 21. The first communication hole 24 communicates with the discharge hole 55 of the piezoelectric pump 101. The second communication hole 22 communicates with the air tank 109. The projecting portion 20 projects toward the first diaphragm 108A side.

As illustrated in FIG. 1 and FIG. 5, a circular hole portion 29 is formed in the first diaphragm 108A at a center portion of a region opposing the projecting portion 20. The first diaphragm 108A makes contact with the projecting portion 20 and is fixed to the first valve housing 21. The hole portion 29 is formed such that the diameter thereof is smaller than the diameter of the surface of the projecting portion 20, which abuts against the first diaphragm 108A.

With this, the first diaphragm 108A divides an inner portion of the first valve housing 21 and configures a ring-like first valve chamber 26 communicating with the first communication hole 24 and a cylindrical second valve chamber 23 communicating with the second communication hole 22.

The projecting portion 20 is formed in the first valve housing 21 so as to pressurize the first diaphragm 108A on the periphery of the hole portion 29.

In the above-mentioned structure, the check valve 102 is opened and closed in the following manner. That is, the first diaphragm 108A makes contact with or is separated from the projecting portion 20 with pressure difference between the first valve chamber 26 and the second valve chamber 23.

Next, the structure of the exhaust valve 103 is described in detail with reference to FIG. 2 and FIG. 6.

Figure 6:
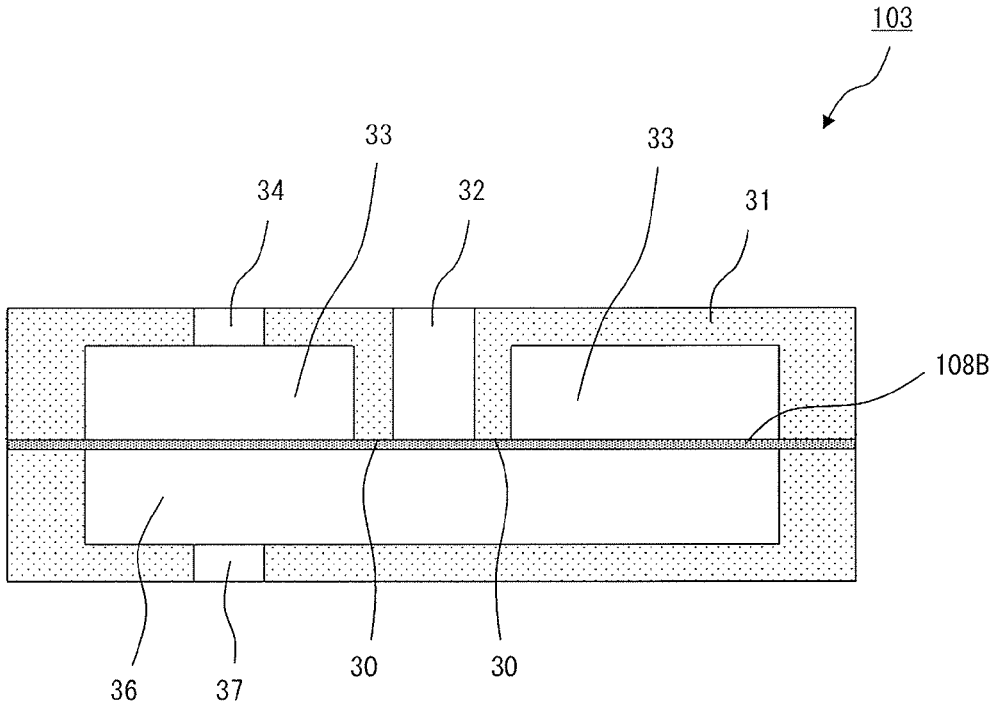
FIG. 6 is a cross-sectional view illustrating a main part of an exhaust valve 103 as illustrated in FIG. 1.

FIG. 6 is a cross-sectional view illustrating a main part of the exhaust valve 103 as illustrated in FIG. 1. The exhaust valve 103 includes a cylindrical second valve housing 31 and a second diaphragm 108B formed by a circular thin film. The second diaphragm 108B is a region of the diaphragm 108 configuring the exhaust valve 103.

A third communication hole 32, a fourth communication hole 37, a fifth communication hole 34, and a valve seat 30 are formed in the second valve housing 31. The third communication hole 32 communicates with the outside of the cooling device 100. The fourth communication hole 37 communicates with the discharge hole 55 of the piezoelectric pump 101 and the first communication hole 24. The fifth communication hole 34 communicates with the air tank 109 and the second communication hole 22. The valve seat 30 projects toward the second diaphragm 108B side from the periphery of the third communication hole 32.

The second diaphragm 108B makes contact with the valve seat 30 and is fixed to the second valve housing 31.

With this, the second diaphragm 108B divides an inner portion of the second valve housing 31 and configures a ring-like third valve chamber 33 communicating with the fifth communication hole 34 and a cylindrical fourth valve chamber 36 communicating with the fourth communication hole 37.

In the above-mentioned structure, the exhaust valve 103 is opened and closed in the following manner. That is, the second diaphragm 108B makes contact with or is separated from the valve seat 30 with pressure difference between the third valve chamber 33 and the fourth valve chamber 36.

The first valve chamber 26 and the fourth valve chamber 36 correspond to a "first region" in the invention and the second valve chamber 23 and the third valve chamber 33 correspond to a "second region" in the invention. Further, the first communication hole 24 and the fourth communication hole 37 correspond to a "first ventilation hole" in the invention. The second communication hole 22 and the fifth communication hole 34 correspond to a "second ventilation hole" in the invention. The third communication hole 32 corresponds to an "exhaust hole" in the invention.

Operations of the analyzing device 10 are described herein.

Figure 7:
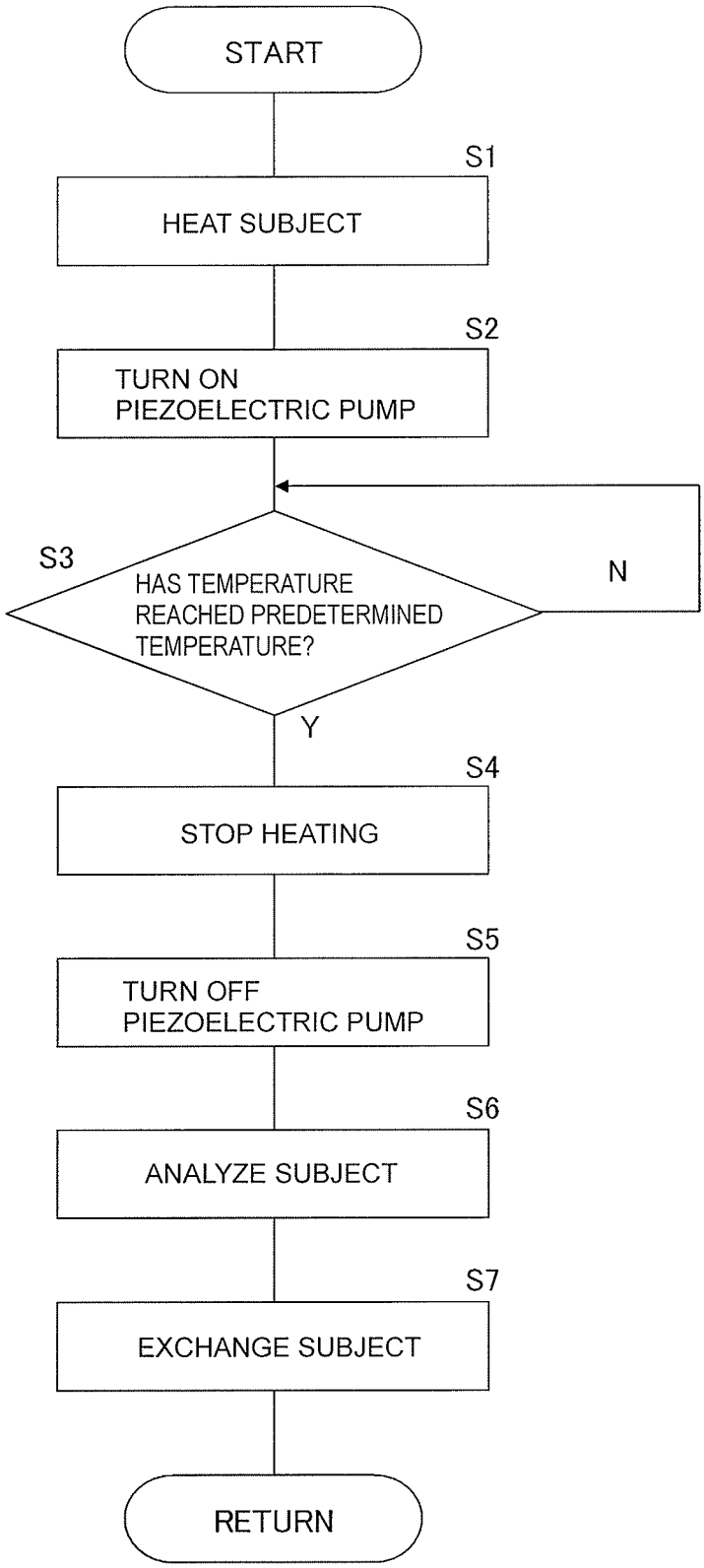
FIG. 7 is a flowchart illustrating operations that are performed by a controller 115 as illustrated in FIG. 1.
Figure 8:
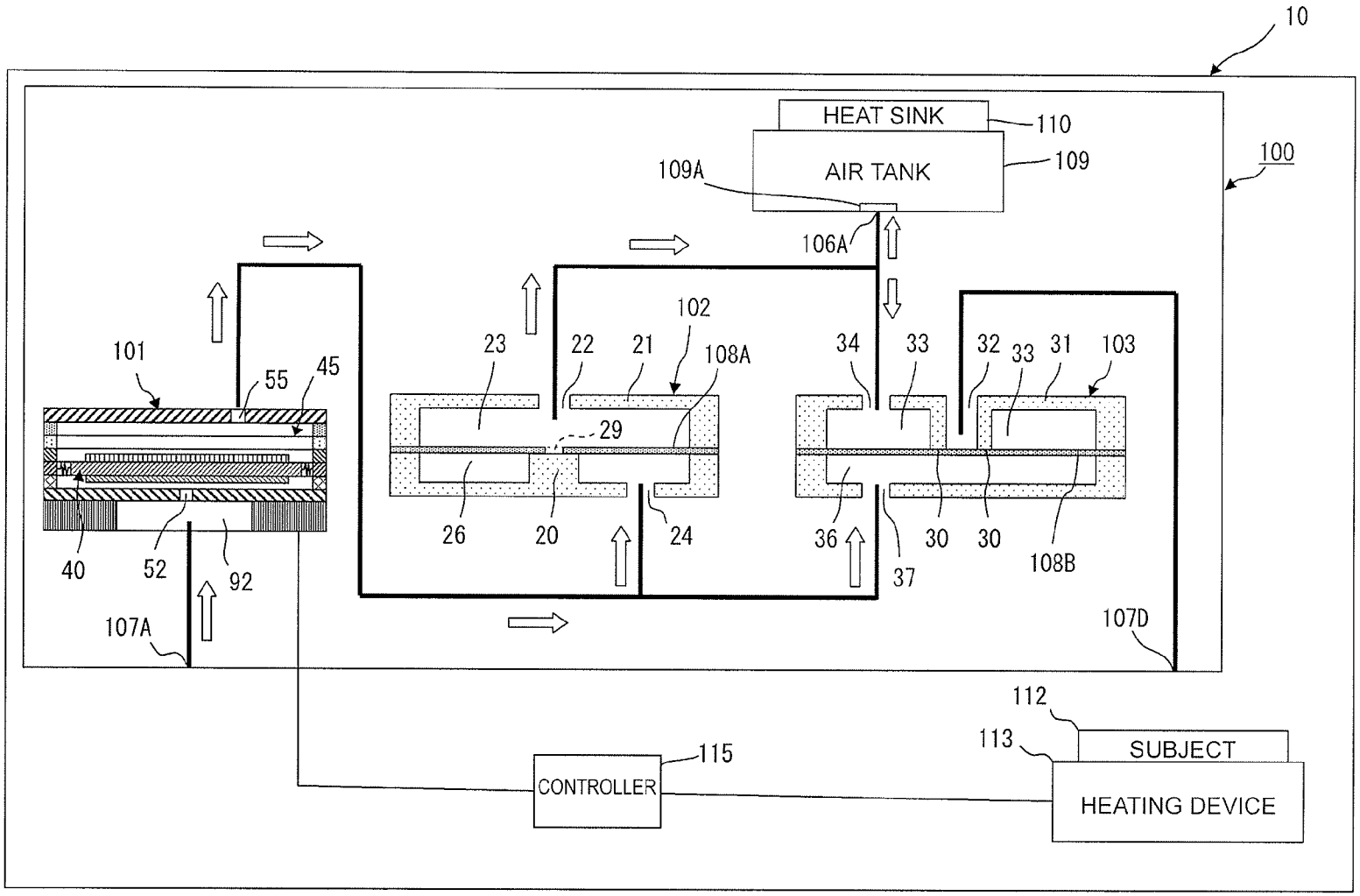
FIG. 8 is a descriptive view illustrating flow of the air when the piezoelectric pump 101 as illustrated in FIG. 1 is driven.
Figure 9:
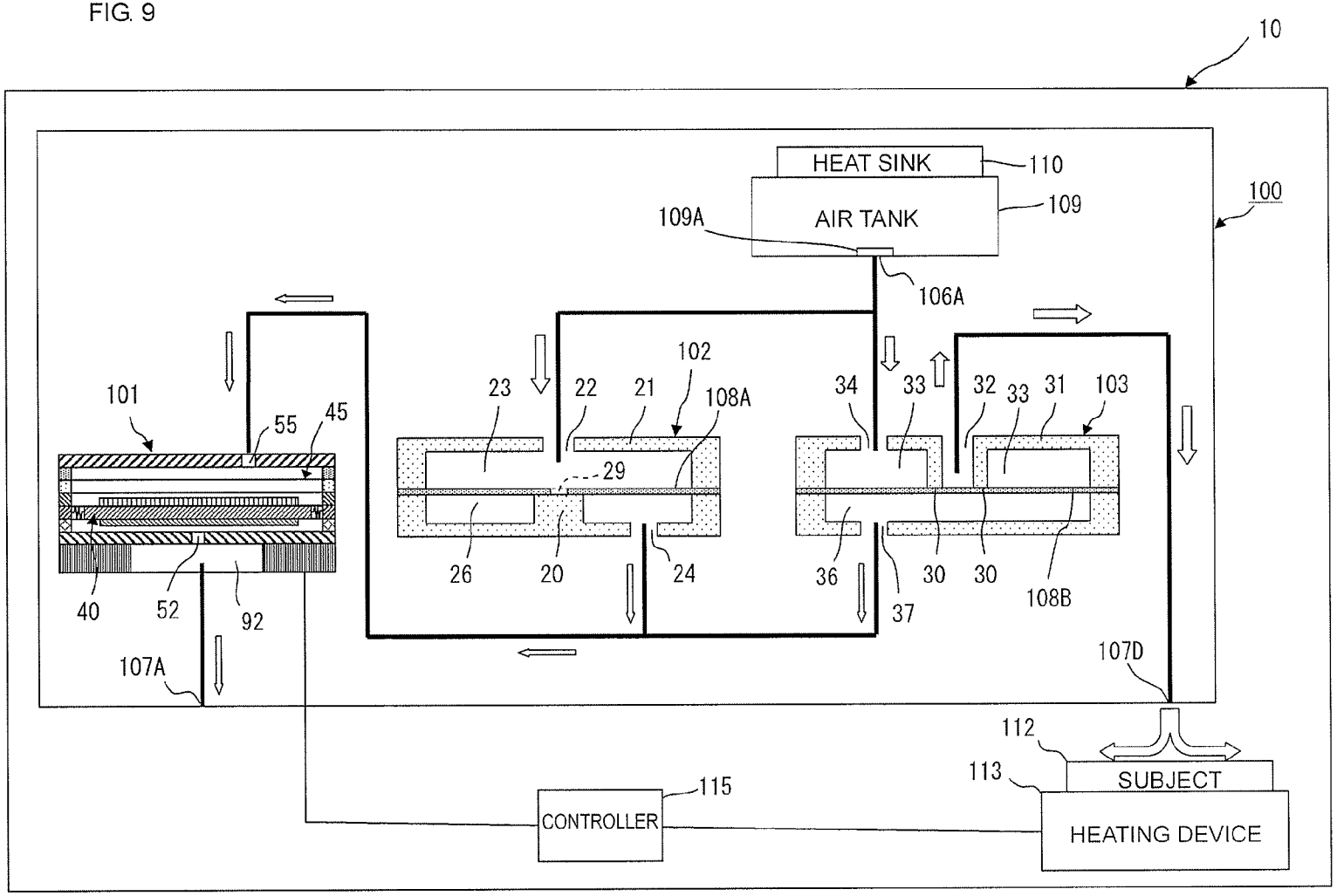
FIG. 9 is a descriptive view illustrating flow of the air immediately after driving of the piezoelectric pump 101 as illustrated in FIG. 1 is stopped.
Figure 10:
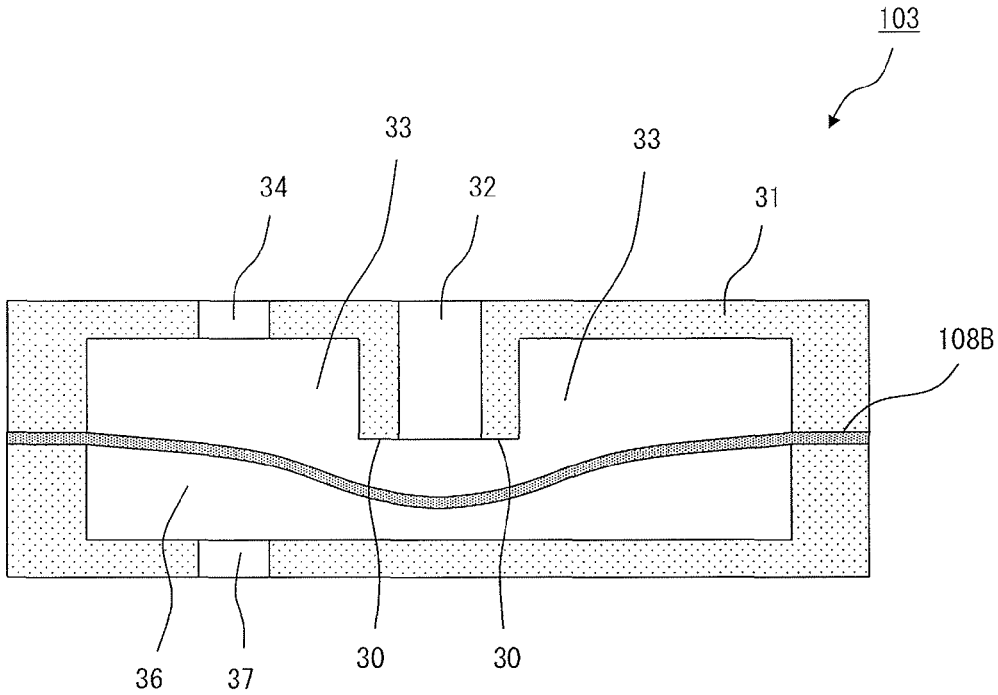
FIG. 10 is a cross-sectional view illustrating a main part when a valve of the exhaust valve 103 as illustrated in FIG. 1 is opened.

FIG. 7 is a flowchart illustrating the operations that are performed by the controller 115 as illustrated in FIG. 1. FIG. 8 is a descriptive view illustrating the flow of the air when the piezoelectric pump 101 as illustrated in FIG. 1 is driven. FIG. 9 is a descriptive view illustrating the flow of the air immediately after driving of the piezoelectric pump 101 as illustrated in FIG. 1 is stopped. Arrows in FIG. 8 and FIG. 9 indicate the flow of the air. FIG. 10 is a cross-sectional view illustrating a main part when the valve of the exhaust valve 103 included in the cooling device 100 according to the first embodiment of the invention is opened.

First, the controller 115 controls to heat the subject 112 accommodating DNA by the heating device 113 (FIG. 7: S1). DNA is denatured with the heating.

As described above, analysis of the base sequence of the DNA is performed after the DNA is heated and denatured.

Then, as illustrated in FIG. 8, the controller 115 controls to drive the piezoelectric pump 101 while the heating device 113 heating the subject 112 (FIG. 7: S2). With this, the outside air is sucked through the suction port 107A and flows into the pump chamber 45 in the piezoelectric pump 101 through the dustproof filter 105A (see FIG. 2). Thereafter, the air that is discharged through the discharge hole 55 of the piezoelectric pump 101 flows into the check valve 102.

Driving of the piezoelectric pump 101 generates a discharge pressure in the forward direction which is toward the second communication hole 22 from the first communication hole 24 in the check valve 102. With this, the pressure in the first valve chamber 26 becomes higher than the pressure in the second valve chamber 23. This causes the first diaphragm 108A to be separated from the projecting portion 20, so that the first communication hole 24 and the second communication hole 22 communicate with each other through the hole portion 29.

Further, the driving of the piezoelectric pump 101 increases the pressure in the fourth valve chamber 36 in the exhaust valve 103. With this, the pressure in the fourth valve chamber 36 becomes higher than the pressure in the third valve chamber 33. This causes the second diaphragm 108B to abut against the valve seat 30 so as to seal the third communication hole 32 and block ventilation between the fifth communication hole 34, the second communication hole 22 and the third communication hole 32.

As a result of the above-mentioned operations, the air is sent to the air tank 109 via the first communication hole 24, the hole portion 29, and the second communication hole 22 of the check valve 102 from the piezoelectric pump 101 (see FIG. 8). When the air is continued to be sent to the air tank 109, the air in the air tank 109 is compressed and the pressure (air pressure) in the air tank 109 is gradually increased. At the same time, the temperature of the air in the air tank 109 is also gradually increased.

Heat of the air in the air tank 109 is conducted to the air tank 109 and the heat sink 110 and is dissipated. Therefore, the increased temperature of the air becomes lower over time so as to be close to the temperature (environment temperature) of the outside air. In the embodiment, the heat sink 110 having excellent heat conductivity is attached to the air tank 109, so that the temperature of the air in the air tank 109 is lowered to the environment temperature quickly.

The first diaphragm 108A is fixed to the first valve housing 21 such that the periphery of the hole portion 29 of the first diaphragm 108A makes contact with the projecting portion 20. The projecting portion 20 pressurizes the first diaphragm 108A on the periphery of the hole portion 29.

With this, the air that flows out through the hole portion 29 via the first communication hole 24 of the check valve 102 flows into the second valve chamber 23 through the hole portion 29 at a pressure slightly lower than the discharge pressure of the piezoelectric pump 101. On the other hand, the discharge pressure of the piezoelectric pump 101 is applied to the first valve chamber 26.

As a result, the pressure in the first valve chamber 26 is slightly higher than the pressure in the second valve chamber 23 in the check valve 102 and a state where the first diaphragm 108A is separated from the projecting portion 20 so as to open the hole portion 29 is kept. Further, the pressure difference between the first valve chamber 26 and the second valve chamber 23 is small, so that the pressure difference does not fluctuate extremely. This can prevent the first diaphragm 108A from being broken.

Further, the cooling device 100 has a structure in which the second communication hole 22 of the check valve 102 and the fifth communication hole 34 of the exhaust valve 103 communicate with each other. The exhaust valve 103 has a shape such that the fifth communication hole 34 is formed in the outer circumference about the third communication hole 32.

With this, the air that flows out through the second communication hole 22 via the first communication hole 24 of the check valve 102 flows into the third valve chamber 33 of the exhaust valve 103 through the fifth communication hole 34 at a pressure slightly lower than the discharge pressure of the piezoelectric pump 101. On the other hand, the discharge pressure of the piezoelectric pump 101 is applied to the fourth valve chamber 36.

As a result, the pressure in the fourth valve chamber 36 is slightly higher than the pressure in the third valve chamber 33 in the exhaust valve 103 and a state where the second diaphragm 108B seals the third communication hole 32 is kept in the exhaust valve 103. Further, the pressure difference between the fourth valve chamber 36 and the third valve chamber 33 is small, so that the pressure difference does not fluctuate extremely. This can prevent the second diaphragm 108B from being broken.

Subsequently, when the temperature of the subject 112 reaches a predetermined temperature (for example, 350 K) (FIG. 7: S3), the controller 115 controls to stop heating of the subject 112 by the heating device 113 (FIG. 7: S4).

Then, as illustrated in FIG. 9, the controller 115 controls to stop the driving of the piezoelectric pump 101 (FIG. 7: S5). It should be noted that the volumes of the pump chamber 45, the first valve chamber 26, and the fourth valve chamber 36 are extremely smaller than the volume of the air that can be accommodated in the air tank 109.

Therefore, when the driving of the piezoelectric pump 101 is stopped, the air in the pump chamber 45, the first valve chamber 26, and the fourth valve chamber 36 is discharged to the outside of the cooling device 100 through the suction port 107A of the cooling device 100 via the suction hole 52 and the opening 92 of the piezoelectric pump 101 quickly. Further, the pressure of the air tank 109 is applied to the second valve chamber 23 and the third valve chamber 33.

As a result, when the driving of the piezoelectric pump 101 is stopped, the pressure in the first valve chamber 26 becomes lower than the pressure in the second valve chamber 23 in the check valve 102. In the same manner, when the driving of the piezoelectric pump 101 is stopped, the pressure in the fourth valve chamber 36 becomes lower than the pressure in the third valve chamber 33 in the exhaust valve 103.

In the check valve 102, when the pressure in the first valve chamber 26 becomes lower than the pressure in the second valve chamber 23, the first diaphragm 108A abuts against the projecting portion 20 so as to seal the hole portion 29. On the other hand, in the exhaust valve 103, when the pressure in the fourth valve chamber 36 becomes lower than the pressure in the third valve chamber 33, the second diaphragm 108B is separated from the valve seat 30 and the fifth communication hole 34 and the third communication hole 32 communicate with each other as illustrated in FIG. 10.

With the above-mentioned operation, the compressed air in the air tank 109 is released into the atmosphere and is adiabatically expanded, so that the temperature of the air becomes lower than the environment temperature. The air (for example, 246 K) of which temperature is lower than the environment temperature is discharged through the discharge port 107D via the fifth communication hole 34 and the third communication hole 32 quickly (see FIG. 9). With this, the air having a high flow rate of which temperature is lower than the environment temperature is discharged toward the subject 112 through the discharge port 107D via the fifth communication hole 34 and third communication hole 32 instantaneously.

Then, the controller 115 controls to analyze the base sequence of the DNA after denature, which is accommodated in the subject 112, by analyzing device 10 (FIG. 7: S6).

Subsequently, the controller 115 controls to transport the subject 112 after being analyzed to another place from a position on the heating device 113 by the transportation unit (not illustrated) and place the subsequent subject 112 onto the heating device 113 by the transportation unit (not illustrated) (FIG. 7: S7). Then, the controller 115 controls to return the process to S1 and continues processing.

It should be noted that the driving of the piezoelectric pump 101 is preferably started for subsequent cooling at S7.

The following describes a specific example using the air tank 109 having the volume of 100 cc and the piezoelectric pump 101 having the discharge pressure of 200 kPa under the condition of the atmospheric pressure of 100 kPa and the environment temperature of 300 K.

First, when the piezoelectric pump 101 is driven, as described above, the air is sent to the air tank 109 via the first communication hole 24, the hole portion 29, and the second communication hole 22 of the check valve 102 from the piezoelectric pump 101.

The piezoelectric pump 101 sends a larger amount of air than the volume 100 cc of the air tank 109 sequentially, so that the air in the air tank 109 is gradually compressed. When the air is compressed in this manner, the pressure in the air tank 109 is increased to 300 kPa finally. At the same time, the temperature of the air in the air tank 109 is gradually increased.

On the other hand, heat of the air in the air tank 109 is conducted to the air tank 109 and the heat sink 110 and is dissipated, so that the increased temperature of the air becomes lower over time to the environment temperature 300 K.

Then, when the driving of the piezoelectric pump 101 is stopped, the first diaphragm 108A abuts against the projecting portion 20 so as to seal the hole portion 29 in the check valve 102 and the second diaphragm 108B is opened and the fifth communication hole 34 and the third communication hole 32 communicate with each other in the exhaust valve 103 as described above.

Therefore, the compressed air in the air tank 109 is released into the atmosphere and is adiabatically expanded, so that the temperature of the air becomes lower than the environment temperature. Thereafter, the air of which temperature is lower than the environment temperature is discharged through the discharge port 107D via the fifth communication hole 34 and the third communication hole 32 quickly (see FIG. 9) while the air of the volume 100 cc in the air tank 109 is made to remain.

With this, the air having a high flow rate of which temperature is lower than the environment temperature is discharged toward the subject 112 through the discharge port 107D via the fifth communication hole 34 and third communication hole 32 instantaneously. In an experiment, it was found that the pressure in the air tank 109 becomes equivalent to the atmospheric pressure in approximately 1.5 seconds when the diameter of the discharge port 107D is approximately 0.5 mm.

First, the change in the volume of the air is obtained by a first equation of $V_1=V_0\times(P_0/P_1)\hat{}(1/1.4)$ based on a Poisson equation and a state equation. In the first equation, it is assumed that the pressure of the air in the air tank 109 immediately before the air is released into the atmosphere is $P_0$, the pressure of the air after the air is released into the atmosphere is $P_1$, the volume of the air in the air tank 109 immediately before the air is released into the atmosphere is $V_0$, and the volume of the air after the air is released into the atmosphere is $V_1$. 1.4 is a value of a specific heat ratio.

$P_0$ is 300 kPa, $P_1$ is 100 kPa, and $V_0$ is 100 cc in this specific example. Based on this, $V_1$ is approximately 164 cc from the first equation. Therefore, the volume of the air that is discharged through the discharge port 107D is approximately 64 cc by subtracting the volume 100 cc of the air tank 109 from $V_1$. The air of approximately 64 cc is discharged in approximately 1.5 seconds, so that an average flow rate is approximately 6.6 L/min. That is to say, the air having a high flow rate is discharged toward the subject 112 through the discharge port 107D instantaneously.

The air is discharged through the discharge port 107D having the diameter of 0.5 mm and sent toward the subject 112 having an extremely small size of approximately 10 mm×10 mm, for example, so as to cool it. The flow rate of the air is high in a common fan motor but the air flows in a region having a fan area of 40 mm×40 mm, for example. Therefore, even when the air that is sent from the fan motor is made to flow toward the subject having the size of approximately 10 mm×10 mm, the air that can be used for cooling is extremely small and cooling efficiency is bad.

The change in the temperature of the air is obtained by a second equation of $T_1=T_0\times(P_0/P_1)\hat{}\{(1-1.4)/1.4\}$ based on the Poisson equation and the state equation. In the second equation, it is assumed that the pressure of the air in the air tank 109 immediately before the air is released into the atmosphere is $P_0$, the pressure of the air after the air is released into the atmosphere is $P_1$, the temperature of the air in the air tank 109 immediately before the air is released into the atmosphere is $T_0$, and the temperature of the air after the air is released into the atmosphere is $T_1$. 1.4 is a value of a specific heat ratio.

$P_0$ is 300 kPa, $P_1$ is 100 kPa, and $T_0$ is 300 K in the specific example. Based on this, the temperature $T_1$ of the air that is discharged through the discharge port 107D is approximately 246 K from the second equation.

Therefore, the temperature of the air that is discharged through the discharge port 107D is lower than the environment temperature (300K).

Accordingly, the air that is cooler than the outside air at the environment temperature can be discharged toward the subject 112. When the heat capacity of the subject 112 is small, for example, the subject 112 can be even frozen.

The volume of the air tank 109 and the discharge pressure of the piezoelectric pump 101 are preferably defined based on the heat capacity of the subject 112 and the lowering amount of the temperature of the subject 112 being lowered.

Accordingly, the cooling device 100 in the embodiment can cool the subject 112 to a temperature that is lower than the environment temperature quickly while being reduced in size. Further, the check valve 102 and the exhaust valve 103 have the configurations of being opened and closed in accordance with the operations of the piezoelectric pump 101, thereby reducing the manufacturing cost.

Further, the analyzing device 10 including the cooling device 100 can obtain the same effects by using the cooling device 100 in the embodiment.

With the cooling device 100 in the embodiment, the piezoelectric pump 101 includes therein an extremely narrow flow path. This arises no risk that a large foreign matter is sent to the air tank 109. Accordingly, the clean air can be sent to the air tank 109. Further, the piezoelectric pump 101 does not generate noise in an audible range when being driven, so that the air can be sent to the air tank 109 silently.

The cooling device 100 in the embodiment has a structural characteristic that a high pressure can be obtained by connecting the piezoelectric pumps 101 in series in multiple stages. It is needless to say that they may be connected in parallel when rapid filling is necessary.

In addition, the cooling device 100 in the embodiment does not use greenhouse gases or combustible substances so as to be used repeatedly.

Further, in the analyzing device 10 in the embodiment, the air is filled into the air tank 109 while the heating device 113 heating the subject 112. Then, after the heating device 113 has completed the heating of the subject 112, the air is discharged toward the subject 112 and cools it. Therefore, the analyzing device 10 in the embodiment can heat and cool the subject 112 quickly.

<<Second Embodiment>>

Hereinafter, an air blower apparatus 11 according to a second embodiment is described.

Figure 11:
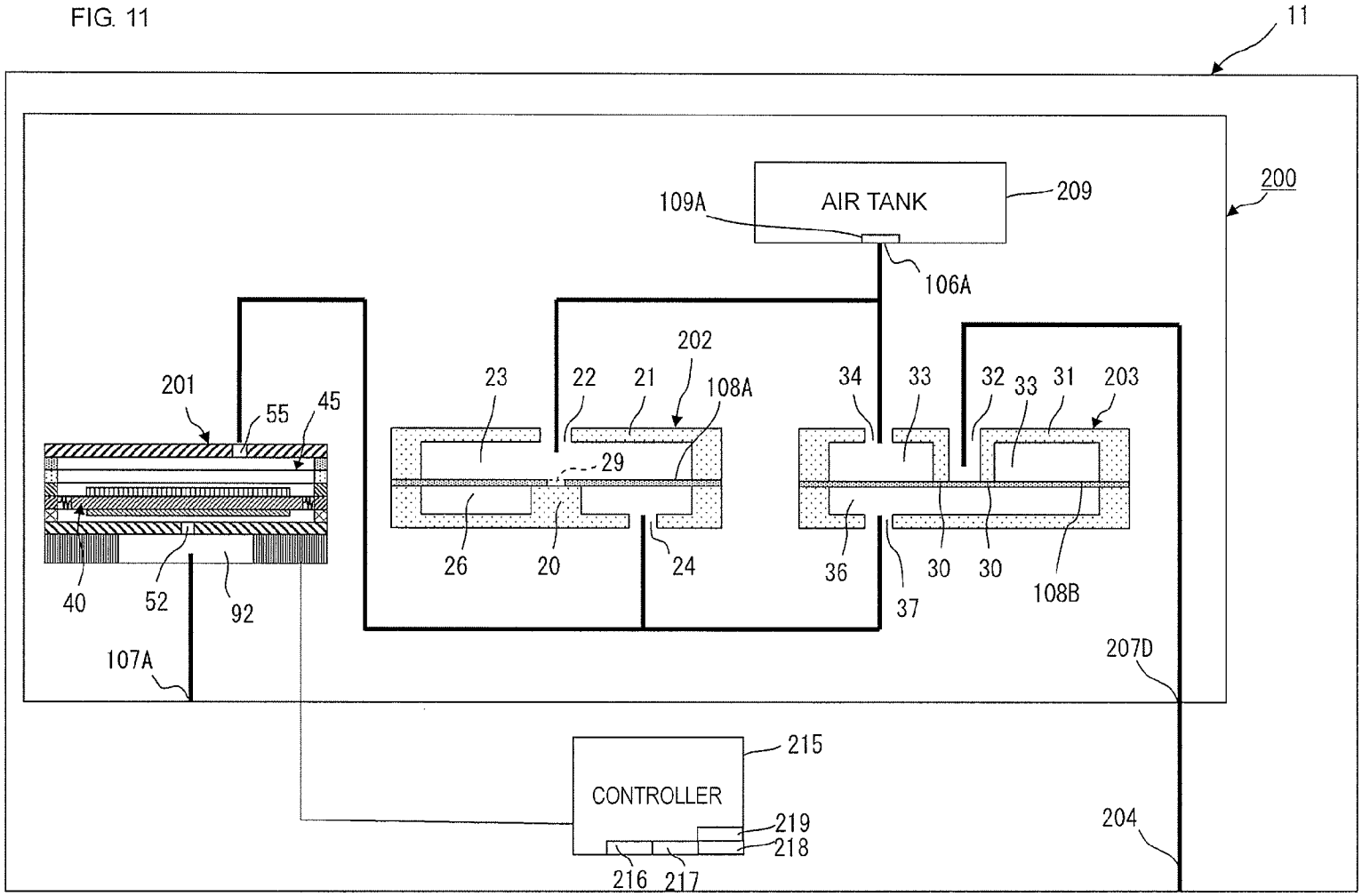
FIG. 11 is a block diagram illustrating the configuration of a main part of an air blower apparatus 11 according to a second embodiment of the invention.
Figure 12:
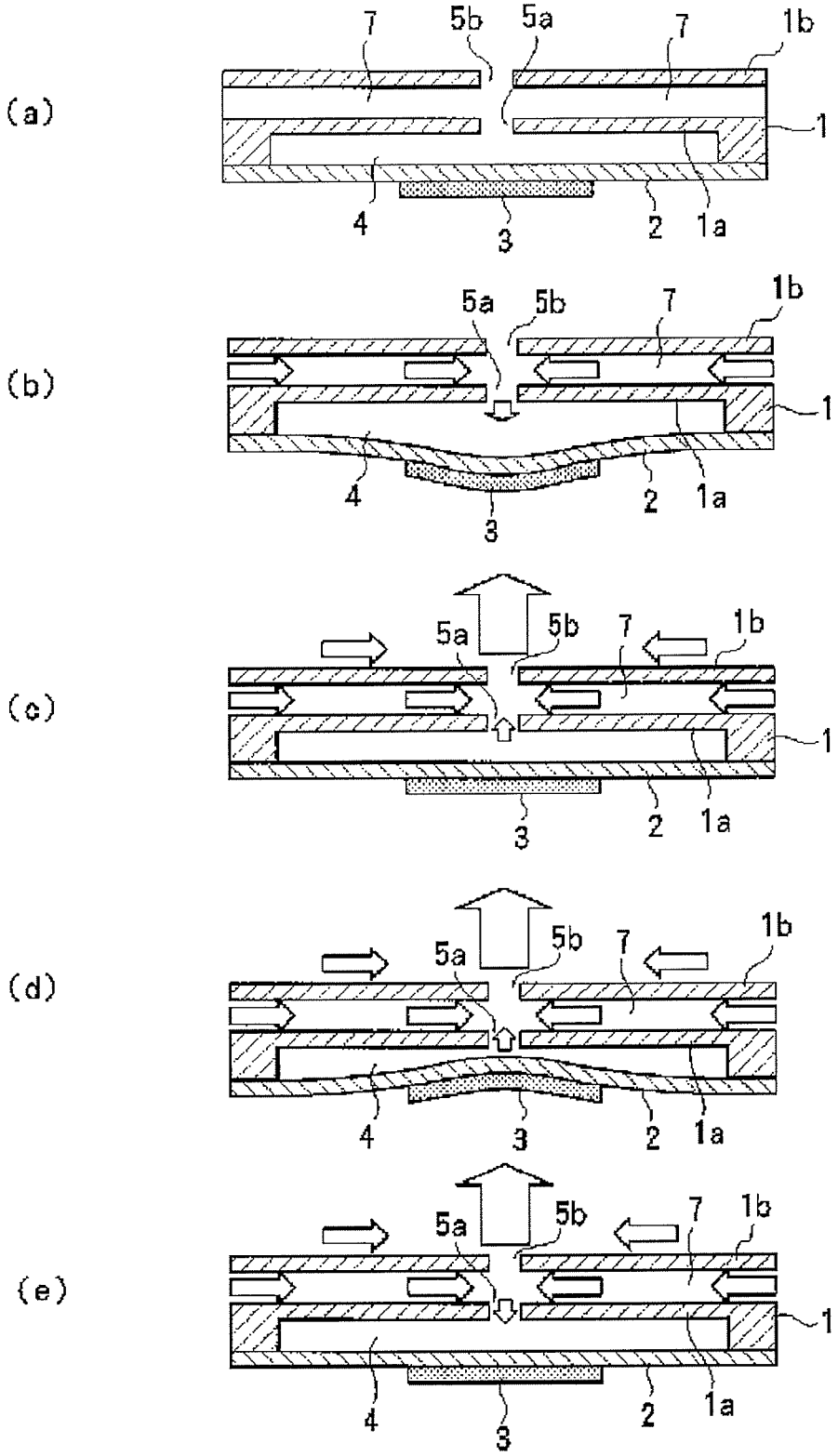
PRIOR ART FIG. 12
FIG. 12 includes cross-sectional views illustrating a main part of a piezoelectric micro blower in Patent Document 1.

FIG. 11 is a block diagram illustrating the configuration of a main part of the air blower apparatus 11 in the second embodiment of the invention. The air blower apparatus 11 includes a cooling device 200 and a controller 215. The air blower apparatus 11 is used as a cold spray, for example.

The cooling device 200 includes a piezoelectric pump 201, a check valve 202, an exhaust valve 203, a discharge nozzle 204, and an air tank 209. The cooling device 200 sends the air to a subject (not illustrated) so as to cool the subject.

The air tank 209 is a pressure-tight container for accommodating the air. The air tank 209 is made of a material having good heat conductivity, such as aluminum or the like.

The subject corresponds to a "cooling target object" in the invention. The check valve 202 corresponds to a "check valve" in the invention and the exhaust valve 203 corresponds to an "exhaust valve" in the invention. A combined entity of the check valve 202 and the exhaust valve 203 corresponds to a "valve" in the invention.

Hereinafter, the configuration of the air blower apparatus 11 is described in detail. The piezoelectric pump 201, the check valve 202, the exhaust valve 203, and the air tank 209 have the same configurations as those of the piezoelectric pump 101, the check valve 102, the exhaust valve 103, and the air tank 109, respectively, in the first embodiment and description thereof is omitted.

A discharge nozzle 204 is formed in a cylindrical shape elongated in the axial direction and one end thereof is provided on a discharge port 207D.

The controller 215 includes a driving circuit 216, a power supply circuit 217, a battery 218, and a driving switch 219. The controller 215 is electrically connected to the piezoelectric pump 201 and transmits a control signal generated by the controller 215 so as to drive the piezoelectric pump 201.

As is described in detail, the controller 215 adjusts a direct-current signal from the battery 218 to an appropriate potential by the power supply circuit 217. Thereafter, the controller 215 adjusts a frequency and a waveform of the direct-current signal by the driving circuit 216 appropriately so as to generate an alternating-current signal (control vibration). The controller 215 applies the generated alternating-current signal to the piezoelectric pump 201 so as to drive the cooling device 200.

The driving switch 219 is of a push-button type, for example. In the air blower apparatus 11, the air is filled into the air tank 209 only during an operator pushing the driving switch 219. The air is discharged from the air tank 209 at the instant of the operator releasing the push of the driving switch 219.

This mechanism can adjust the discharge flow rate and the discharge pressure of the air easily. Accordingly, the air blower apparatus 11 in the embodiment obtains the same effects as those in the above-mentioned cooling device 100.

The air blower apparatus 11 can be used as the cold spray and also as an air duster.

<<Other Embodiments>>

Although the air is used as gas in the above-mentioned embodiments, the gas is not limited thereto and the invention can be applied to a case where the gas is a gas other than the air.

Although the cooling device 100 cools the subject 112 accommodating the DNA in the above-mentioned embodiments, the cooling target is not limited thereto. For example, the cooling device 100 may cool an electronic component such as a CPU. In the same manner, although the analyzing device 10 is used as the heating and cooling apparatus in the above-mentioned embodiments, the heating and cooling apparatus is not limited thereto.

Further, although the actuator 40 that bends and vibrates in a unimorph type fashion is provided in the above-mentioned embodiments, the actuator 40 may be configured to bend and vibrate in a bimorph type fashion by bonding the piezoelectric elements 42 to both the surfaces of the vibration plate 41.

In addition, although the pump in the above-mentioned embodiments includes the actuator 40 that bends and vibrates with the expansion and contraction of the piezoelectric element 42, the actuator 40 is not limited thereto. For example, the pump may include an actuator that bends and vibrates with electromagnetic driving.

Further, although the piezoelectric element 42 is made of PZT-based ceramics in the above-mentioned embodiments, the piezoelectric element 42 is not limited to being made of it. For example, the piezoelectric element 42 may be made of a piezoelectric material of non-lead-based piezoelectric ceramics such as potassium sodium niobate-based ceramics, alkali niobate-based ceramics, or the like.

Further, although the heat sink 110 is provided on the outer side portion of the air tank 109 in the above-mentioned embodiments, the heat sink 110 is not limited to being provided thereon. For example, the heat sink 110 may be provided on the inner side portion of the air tank 109 so as to release heat of the air in the air tank 109 to the air tank 109 from the heat sink 110.

In addition, although the air tank 109 is attached to the lid member 106 in a detachable manner as illustrated in FIG. 2 in the above-mentioned embodiments, the air tank 109 is not limited to being attached in this manner. For example, the air tank 109 may be fixed to the lid member 106 not in the detachable manner but permanently.

Finally, descriptions in the above-mentioned embodiments are examples in all ways and should not be considered to be limiting. The scope of the present invention is defined not by the above-mentioned embodiments but by the applied claims. Moreover, the scope of the present invention is intended to encompass all meanings equivalent to the appended claims as well as all changes within the scope of the appended claims.

REFERENCE SIGNS LIST

1 BLOWER MAIN BODY
1*a* FIRST WALL PORTION
1*b* SECOND WALL PORTION
2 DIAPHRAGM
3 PIEZOELECTRIC ELEMENT
4 BLOWER CHAMBER
5*a* FIRST OPENING
5*b* SECOND OPENING
7 INLET PASSAGE
10 ANALYZING DEVICE
20 PROJECTING PORTION
21 FIRST VALVE HOUSING
22 SECOND COMMUNICATION HOLE
23 FIRST VALVE CHAMBER
24 FIRST COMMUNICATION HOLE
26 SECOND VALVE CHAMBER
30 VALVE SEAT
31 SECOND VALVE HOUSING
32 THIRD COMMUNICATION HOLE
33 THIRD VALVE CHAMBER
34 FIFTH COMMUNICATION HOLE
36 FOURTH VALVE CHAMBER
37 FOURTH COMMUNICATION HOLE
40 PIEZOELECTRIC ACTUATOR
41 VIBRATION PLATE
42 PIEZOELECTRIC ELEMENT
43 REINFORCING PLATE
45 PUMP CHAMBER
51 FLEXIBLE PLATE
52 SUCTION HOLE
53A, 53B, 53C SPACER
54 LID PLATE
55 DISCHARGE HOLE
56 MOVABLE PORTION
57 FIXING PORTION
60 VIBRATION PLATE UNIT
61 FRAME PLATE
62 COUPLING PORTION
63, 72 EXTERNAL TERMINAL
70 ELECTRODE CONDUCTION PLATE
71 FRAME SITE
73 INTERNAL TERMINAL
80 PUMP HOUSING
91 SUBSTRATE
92 OPENING
95 COVER PLATE PORTION
96 FLOW PATH PLATE
97 COMMUNICATION PATH
98 THROUGH-HOLE
99 COVER PLATE
100, 200 COOLING DEVICE
101, 201 PIEZOELECTRIC PUMP
102, 202 CHECK VALVE
103, 203 EXHAUST VALVE
105 VALVE HOUSING
105A DUSTPROOF FILTER
106 LID MEMBER
106A CONNECTION PORT
107 SUBSTRATE
107A SUCTION PORT
107B INLET PATH
107C OUTLET PATH
107D DISCHARGE PORT
108 DIAPHRAGM
109, 209 AIR TANK
109A VENTILATION PORT
110 HEAT SINK
112 SUBJECT
113 HEATING DEVICE
115 CONTROLLER
204 NOZZLE
215 CONTROLLER
P PACKING

The invention claimed is:

1. A cooling device comprising:
a pump having a suction hole and a discharge hole;
a tank that accommodates a gas; and
a valve having a first ventilation hole in fluid communication with the discharge hole of the pump, a second ventilation hole in fluid communication with the tank, and an exhaust hole that discharges the gas in the tank,
wherein the valve is configured to switch between a first communication state where the first ventilation hole and the second ventilation hole fluidly communicate with each other and gas flow is blocked between the second ventilation hole and the exhaust hole and a second communication state where gas flow is blocked between the first ventilation hole and the second ventilation hole and the second ventilation hole fluidly communicates with the exhaust hole.

2. The cooling device according to claim 1,
wherein the valve includes a valve housing in which the first ventilation hole, the second ventilation hole, and the exhaust hole are disposed, and
wherein a diaphragm divides an inner portion of the valve housing such that a first region is in fluid communication with the first ventilation hole and a second region is in fluid communication with the second ventilation hole in the valve housing.

3. The cooling device according to claim 2, wherein the diaphragm is fixed to the valve housing such that:
the first ventilation hole and the second ventilation hole are in fluid communication with each other and gas flow is blocked between the second ventilation hole and the exhaust hole when a pressure in the first region is higher than a pressure in the second region, and
gas flow is blocked between the first ventilation hole and the second ventilation hole and the second ventilation hole and the exhaust hole are in fluid communication with each other when the pressure in the first region is lower than the pressure in the second region.

4. The cooling device according to claim 1, wherein a heat sink is attached to the tank to cool the gas accommodated by the tank.

5. The cooling device according to claim 3, wherein the valve housing and the diaphragm collectively form a check valve that controls fluid communication between the first ventilation hole and the second ventilation hole based on a pressure difference between the first region and the second region.

6. The cooling device according to claim 5, wherein the valve housing and the diaphragm collectively form an exhaust valve that controls fluid communication between the second ventilation hole and the exhaust hole based on the pressure difference between the first region and the second region.

7. The cooling device according to claim 2, wherein the diaphragm is define by a single flexible plate.

8. A heating and cooling apparatus comprising:

the cooling device according to claim 1; and a heating device for heating a target object, wherein the pump of the cooling device is driven while the heating device is heating the target object and the pump of the cooling device is not driven once the heating device stops heating the target object.

* * * * *